US011333444B2

(12) United States Patent
Chen et al.

(10) Patent No.: US 11,333,444 B2
(45) Date of Patent: May 17, 2022

(54) HEAT-EXCHANGE APPARATUS

(71) Applicant: Delta Electronics, Inc., Taoyuan (TW)

(72) Inventors: Lee-Long Chen, Taoyuan (TW); Wu-Chi Li, Taoyuan (TW); Chia-Wei Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 188 days.

(21) Appl. No.: 16/881,847

(22) Filed: May 22, 2020

(65) Prior Publication Data

US 2020/0284524 A1 Sep. 10, 2020

Related U.S. Application Data

(63) Continuation of application No. 14/292,427, filed on May 30, 2014, now Pat. No. 10,697,709.

(30) Foreign Application Priority Data

Oct. 31, 2013 (CN) ..... 201310536088.4

(51) Int. Cl.
*F28D 15/00* (2006.01)
*F28D 15/02* (2006.01)
(Continued)

(52) U.S. Cl.
CPC ..... *F28D 15/0266* (2013.01); *F28F 13/06* (2013.01); *F28F 19/00* (2013.01); *F28D 2015/0216* (2013.01)

(58) Field of Classification Search
CPC ..... F28D 15/0266; F28D 2015/0216; F28D 13/06; F28D 19/00; F28D 1/0426;
(Continued)

(56) References Cited

U.S. PATENT DOCUMENTS 4,452,051 A 6/1984 Berger
5,341,870 A 8/1994 Hughes
(Continued)

FOREIGN PATENT DOCUMENTS

CN 201992742 9/2011
JP 2005226878 A 8/2005
TW 201336398 9/2013

*Primary Examiner* — Henry T Crenshaw
*Assistant Examiner* — Kamran Tavakoldavani
(74) *Attorney, Agent, or Firm* — Muncy, Geissler, Olds & Lowe, P.C.

(57) ABSTRACT

A heat-exchange apparatus is provided, including a first heat exchanger, a second heat exchanger, a third heat exchanger and a fourth heat exchanger. The first heat exchanger is thermally separated from the second heat exchanger. The third heat exchanger is thermally connected to the first heat exchanger. The fourth heat exchanger is thermally connected to the second heat exchanger, wherein a first air flow passes through the first heat exchanger and the second heat exchanger to be divided into a first divergent flow and a second divergent flow, the first divergent flow flows on a surface of the first heat exchanger, the second divergent flow flows on a surface of the second heat exchanger, the first divergent flow does not flow on the surface of the second heat exchanger, and the second divergent flow does not flow on the surface of the first heat exchanger.

7 Claims, 2 Drawing Sheets

(51) Int. Cl.
*F28F 19/00* (2006.01)
*F28F 13/06* (2006.01)

(58) Field of Classification Search
CPC .. F28D 2001/0266; F28D 7/0075; F28B 1/06; F28B 7/00; H05K 7/206; H05K 7/202
USPC ..... 165/104.21
See application file for complete search history.

(56) References Cited

U.S. PATENT DOCUMENTS

| | | | | |
|---|---|---|---|---|
| 6,793,010 | B1 | 9/2004 | Mangle | |
| 9,303,882 | B2 | 4/2016 | Hancock | |
| 9,791,221 | B1 | 10/2017 | Litch | |
| 2005/0274120 | A1 | 12/2005 | Quisenberry et al. | |
| 2008/0014854 | A1 | 1/2008 | Tigner | |
| 2009/0220334 | A1* | 9/2009 | Vouche ..... | F04D 29/664 415/119 |
| 2010/0041327 | A1 | 2/2010 | Desler | |
| 2010/0326624 | A1 | 12/2010 | Hancock | |
| 2012/0186787 | A1 | 7/2012 | Dinh | |

* cited by examiner

HEAT-EXCHANGE APPARATUS

CROSS REFERENCE TO RELATED APPLICATIONS

This application is a Continuation of U.S. patent application Ser. No. 14/292,427, filed May 30, 2014 and entitled "Heat-exchange apparatus", which claims priority of China Patent Application No. 201310536088.4, filed on Oct. 31, 2013, the entirety of which is incorporated by reference herein.

BACKGROUND OF THE INVENTION

Field of the Invention

The present invention relates to heat-exchange apparatus, and in particular to a vapor-liquid heat-exchange apparatus.

Description of the Related Art

A vapor-liquid heat-exchange apparatus vaporizes a work fluid in a plurality of evaporators by heating the work fluid, and the vaporized work fluid flows to a plurality of condensers. When the vaporized work fluid is in the condensers, the vaporized work fluid is cooled and liquefied, and the liquefied work fluid flows back to the evaporators. The circulated work fluid transmits heat.

In the conventional vapor-liquid heat-exchange apparatus, the evaporators and the condensers are stacked to contact air. However, the stacked evaporator sands tacked condensers have increased wind resistance, and cause increased power consumption. Additionally, the condensers are exposed to the outer air, and dust can adhere to the condensers.

BRIEF SUMMARY OF THE INVENTION

A heat-exchange apparatus is provided, including a first heat exchanger, a second heat exchanger, a third heat exchanger and a fourth heat exchanger. The first heat exchanger is thermally separated from the second heat exchanger. The third heat exchanger is thermally connected to the first heat exchanger. The fourth heat exchanger is thermally connected to the second heat exchanger, wherein a first air flow passes through the first heat exchanger and the second heat exchanger to be divided into a first divergent flow and a second divergent flow. The first divergent flow flows on the surface of the first heat exchanger, and the second divergent flow flows on the surface of the second heat exchanger The first divergent flow does not flow on the surface of the second heat exchanger, and the second divergent flow does not flow on the surface of the first heat exchanger.

The first heat exchanger and the second heat exchanger compose a structure similar to a V shape or a U shape. Without increasing the heat-dissipating area of the heat exchanger, the V-shaped or U-shaped arrangement has decreased wind resistance, and provides increased wind flow rate. The heat dissipation ability of the heat-exchange apparatus is increased, and dust adhering to the heat-exchange apparatus can be reduced.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
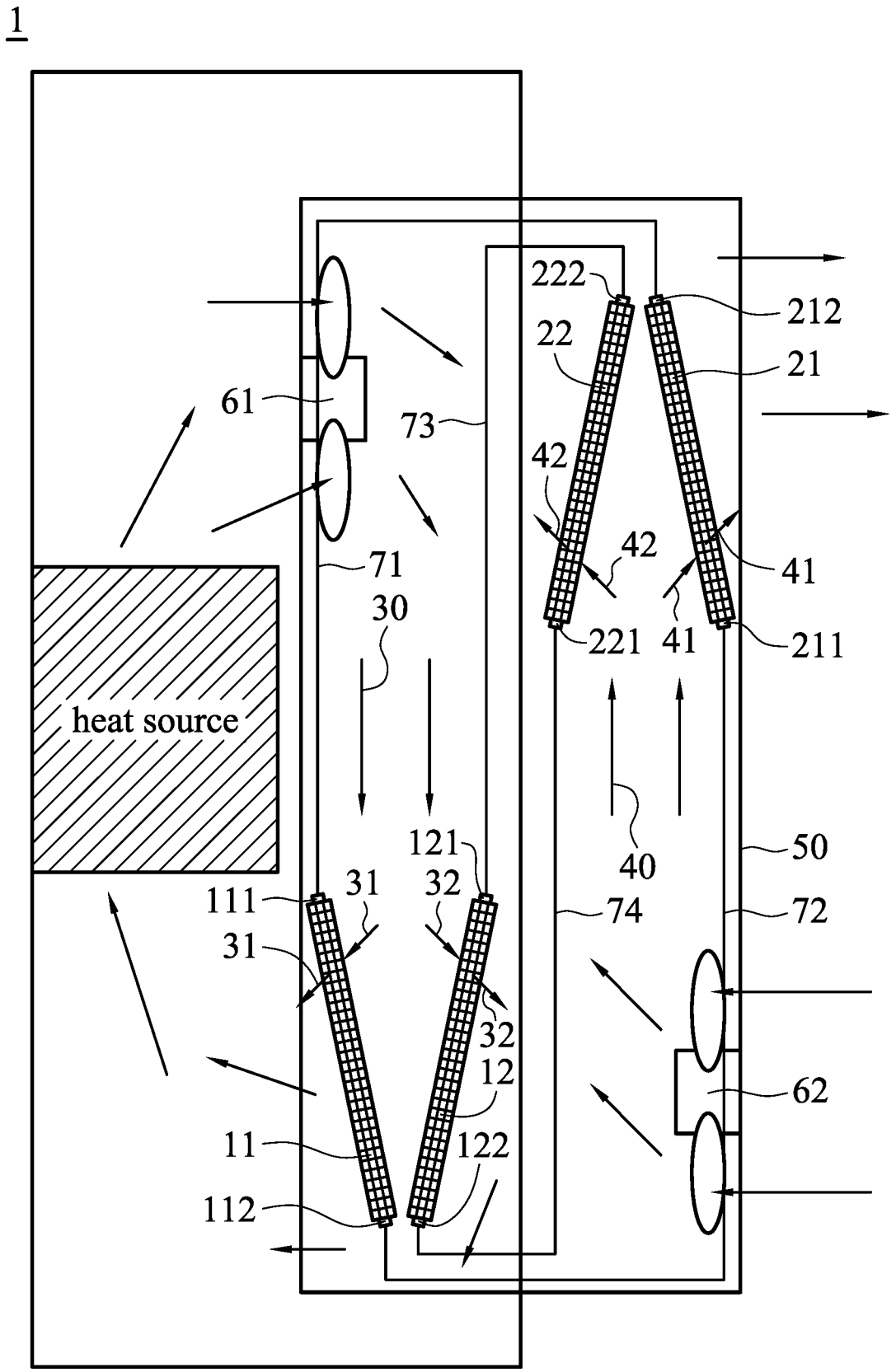
FIG. 1 shows a heat-exchange apparatus of an embodiment of the invention.

FIG. 1 shows a heat-exchange apparatus 1 of an embodiment of the invention, including a first heat exchanger 11, a second heat exchanger 12, a third heat exchanger 21 and a fourth heat exchanger 22. The third heat exchanger 21 is thermally connected to the first heat exchanger 11. The fourth heat exchanger 22 is thermally connected to the second heat exchanger 12. The first heat exchanger 11 is thermally separated from the second heat exchanger 12. The third heat exchanger 21 is thermally separated from the fourth heat exchanger 22. A first air flow 30 passes through the first heat exchanger 11 and the second heat exchanger 12 to be divided into a first divergent flow 31 and a second divergent flow 32. The first divergent flow 31 flows on a surface of the first heat exchanger 11. The second divergent flow 32 flows on a surface of the second heat exchanger 12. The first divergent flow 31 does not flow on the surface of the second heat exchanger 12, and the second divergent flow 32 does not flow on the surface of the first heat exchanger 11. A second air flow 40 passes through the third heat exchanger 21 and the fourth heat exchanger 22 to be divided into a third divergent flow 41 and a fourth divergent flow 42. The third divergent flow 41 flows on a surface of the third heat exchanger 21. The fourth divergent flow 42 flows on a surface of the fourth heat exchanger 22. The third divergent flow 41 does not flow on the surface of the fourth heat exchanger 22, and the fourth divergent flow 42 does not flow on the surface of the third heat exchanger 21.

The first heat exchanger 11 and the second heat exchanger 12 compose a structure similar to a V shape or a U shape. Without increasing the heat-dissipating area of the heat exchanger, the V-shaped or U-shaped arrangement has decreased wind resistance, and provides an increased wind flow rate. The heat dissipation ability of the heat-exchange apparatus is increased, and dust adhering to the heat-exchange apparatus can be reduced.

In one embodiment, an included angled is formed between an extending direction of the first heat exchanger 11 and an extending direction of the second heat exchanger 12, and the included angled not greater than 90° and is not 0°.

In one embodiment, the heat-exchange apparatus 1 of the embodiment of the invention further includes a housing 50, a first fan 61 and a second fan 62. The first heat exchanger 11, the second heat exchanger 12, the third heat exchanger 21 and the fourth heat exchanger 22 are received in the housing 50. The first fan 61 generates the first flow 30, and moves the first flow 30 passing through the first heat exchanger 11 and the second heat exchanger 12. The second fan 62 generates the second flow 40, and moves the second flow 40 passing through the third heat exchanger 21 and the fourth heat exchanger 22. Utilizing the heat-exchange apparatus 1 of the embodiment of the invention, due to the decreased wind resistance, the rotation speed of the first fan 61 and the second fan 62 can be decreased under a predetermined wind flow rate, and the power consumption of the first fan 61 and the second fan 62 can therefore be reduced.

The first heat exchanger 11 comprises a first outlet 111 and a first inlet 112, the second heat exchanger 12 comprises a second outlet 121 and a second inlet 122, the third heat exchanger 21 comprises a third outlet 211 and a third inlet 212, and the fourth heat exchanger 22 comprises a fourth outlet 221 and a fourth inlet 222. A first pipe 71 connects the first outlet 111 to the third inlet 212, a second pipe 72 connects the third outlet 211 to the first inlet 112, a third pipe 73 connects the second outlet 121 to the fourth inlet 222, and a fourth pipe 71 connects the fourth outlet 221 to the second inlet 122. Utilizing the first pipe 71, the second pipe 72, the third pipe 73 and the fourth pipe 74, a work fluid exchanges heat between the first heat exchanger 11, the second heat exchanger 12, the third heat exchanger 21 and the fourth heat exchanger 22.

In this embodiment, the first heat exchanger 11 and the second heat exchanger 12 are evaporators, and the third heat exchanger 21 and the fourth heat exchanger 22 are condensers. The first heat exchanger 11 and the second heat exchanger 12 vaporize the work fluid, and the vaporized work fluid is moved to the third heat exchanger 21 and the fourth heat exchanger 22 by pressure. The third heat exchanger 21 and the fourth heat exchanger 22 liquefy the work fluid, and the liquefied work fluid is moved to the first heat exchanger 11 and the second heat exchanger 12 by gravity.

In one embodiment, in a dust-removal mode, the first fan 61 and the second fan 62 can rotate inversely to change the air-flow direction. Therefore, the dust adhering to the heat-exchange apparatus 1 can be removed by the air flow changing direction, and the dust-accumulation problem can be improved.

Figure 2:
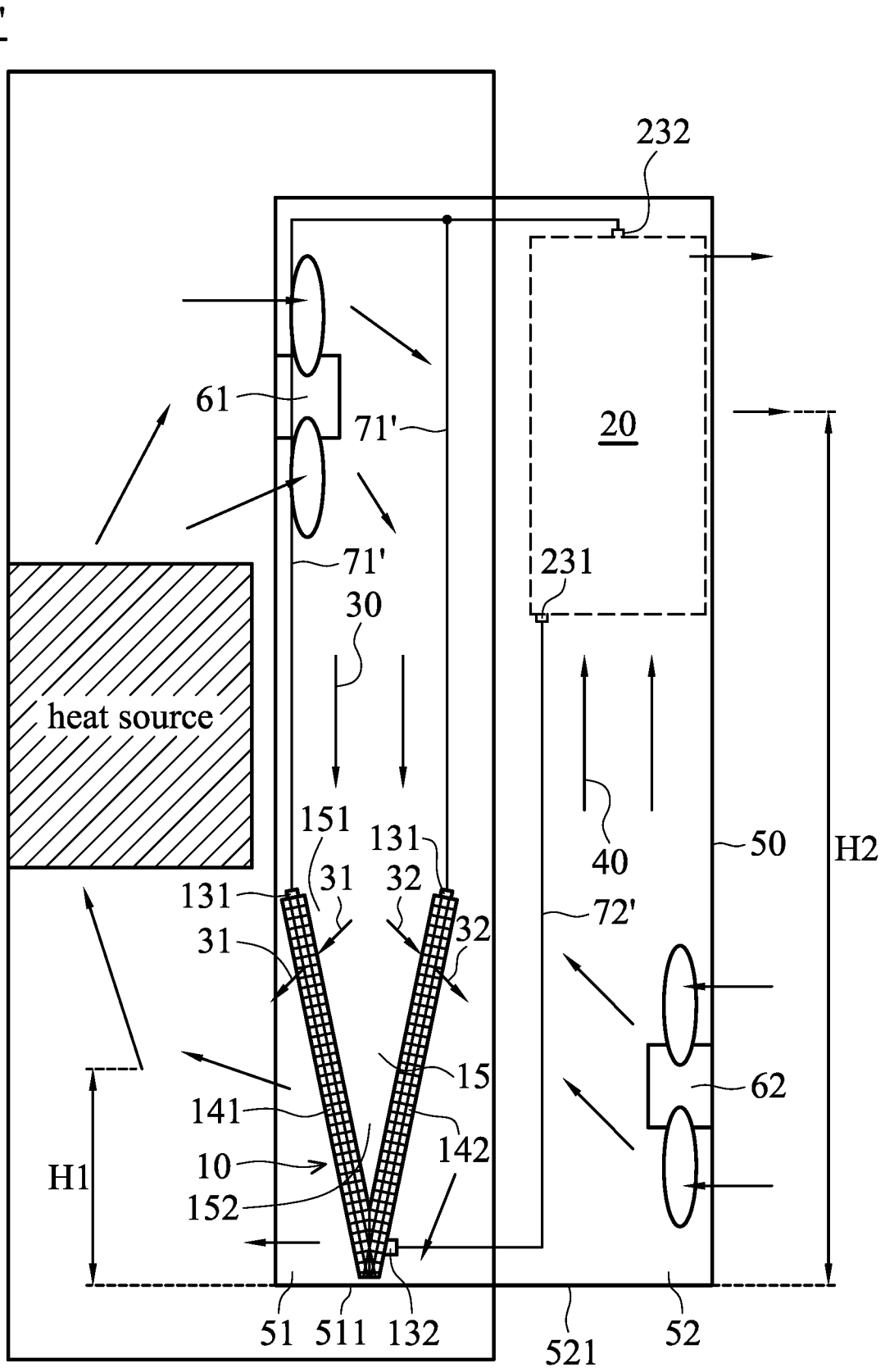
FIG. 2 shows a heat-exchange apparatus of another embodiment of the invention.

In the embodiment above, the first heat exchanger 11 and the second heat exchanger 12 are individual elements which form V-shaped structure, U-shaped structure or other suitable structure. However, the structure of the heat exchanger can be properly designed to be an integrally formed V-shaped structure, U-shaped structure, W shaped structure or an integral structure with an included angle at a wind-facing surface. FIG. 2 shows a heat-exchange apparatus 1' of another embodiment of the invention, including a first heat exchanger 10 and a second heat exchanger 20. The second heat exchanger 20 is thermally connected to the first heat exchanger 10, wherein a first air flow 30 passes through the first heat exchanger 10 to be divided into a first divergent flow 31 and a second divergent flow 32. When the first divergent flow 31 and the second divergent flow 32 leave the first heat exchanger 10, a first flow direction of the first divergent flow 31 differs from a second flow direction of the second divergent flow 32. The first heat exchanger 10 is a V-shaped structure having a first straight longitudinal portion 141 and a second straight longitudinal portion 142, and an end of the first straight longitudinal portion 141 directly connects to an end of the second straight longitudinal portion 142 at a single point. A V-shaped opening 15 is formed between the first straight longitudinal portion 141 and the second straight longitudinal portion 142, and the V-shaped opening 15 faces the first fan 61. The first heat exchanger 10 is in a first chamber 51, and the second heat exchanger 20 is in a second chamber 52 independent from the first chamber 51. The first heat exchanger 10 is an evaporator, and the second heat exchanger 20 is a condenser. The V-shaped structure has the V-shaped opening 15. The V-shaped opening 15 has an open portion 151 and an end portion 152. A size of the open portion 151 is greater than a size of the end portion 152. The first air flow 30 generated by the first fan enters the V-shaped opening 15 via the open portion 151, and the first air flow 30 travels from the open portion 151 toward the end portion 152. The first heat exchanger 10 is in a first height H1 relative to a first bottom 511 of the first chamber 51. The second heat exchanger 20 is in a second height H2 relative to a second bottom 521 of the second chamber 52. The first bottom 511 and the second bottom 521 are the same height or coplanar.

In one embodiment, the heat-exchange apparatus 1' of the embodiment of the invention further includes a housing 50, a first fan 61 and a second fan 62. The first heat exchanger 10 and the second heat exchanger 20 are received in the housing 50. The first fan 61 generates the first flow 30, and moves the first flow 30 passing through the first heat exchanger 10. The second fan 62 generates the second flow 40, and moves the second flow 40 passing through the second heat exchanger 20. Utilizing the heat-exchange apparatus 1' of the embodiment of the invention, due to the decreased wind resistance, the rotation speed of the first fan 61 and the second fan 62 can be decreased under a predetermined wind flow rate, and the power consumption of the first fan 61 and the second fan 62 can be therefore reduced. In one embodiment, the first heat exchanger 10 is a V-shaped structure having a structural notch 13, and the structural notch 13 faces the first fan 61.

The first heat exchanger 10 comprises first outlets 131 and a first inlet 132, and the second heat exchanger 20 comprises a second outlet 231 and a second inlet 232. The first pipe 71' connects the first outlets 131 to the second inlet 232, and the second pipe 72' connects the second outlet 231 to the first inlet 132. Utilizing the first pipe 71' and the second pipe 72', a work fluid exchanges heat between the first heat exchanger 10 and the second heat exchanger 20.

Similar to the embodiment of FIG. 1, in the embodiment of FIG. 2, in a dust-removal mode, the first fan 61 and the second fan 62 can be inversely rotated to change air flow direction. Therefore, the dust adhering to the heat-exchange apparatus 1' can be removed by the air flow direction changing, and the dust accumulation problem can be improved.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A heat-exchange apparatus, comprising:

a first heat exchanger;

a second heat exchanger, wherein the first heat exchanger is thermally separated from the second heat exchanger;

a third heat exchanger, thermally connected to the first heat exchanger;

a fourth heat exchanger, thermally connected to the second heat exchanger, wherein a first air flow passes through the first heat exchanger and the second heat exchanger to be divided into a first divergent flow and a second divergent flow, the first divergent flow flows on a surface of the first heat exchanger, the second divergent flow flows on a surface of the second heat exchanger, the first divergent flow does not flow on the surface of the second heat exchanger, and the second divergent flow does not flow on the surface of the first heat exchanger.

2. The heat-exchange apparatus as claimed in claim 1, wherein the third heat exchanger is thermally separated from the fourth heat exchanger, a second air flow passes through the third heat exchanger and the fourth heat exchanger to be divided into a third divergent flow and a fourth divergent flow, the third divergent flow flows on a surface of the third heat exchanger, the fourth divergent flow flows on a surface of the fourth heat exchanger, the third divergent flow does not flow on the surface of the fourth heat exchanger, and the fourth divergent flow does not flow on the surface of the third heat exchanger.

3. The heat-exchange apparatus as claimed in claim 1, further comprising: a housing, wherein at least the first heat exchanger and the second heat exchanger are received in the housing; and a first fan, generating the first air flow.

4. The heat-exchange apparatus as claimed in claim 1, wherein the first heat exchanger comprises a first outlet and a first inlet, the second heat exchanger comprises a second outlet and a second inlet, the third heat exchanger comprises a third outlet and a third inlet, the fourth heat exchanger comprises a fourth outlet and a fourth inlet, a first pipe connects the first outlet to the third inlet, a second pipe connects the third outlet to the first inlet, a third pipe connects the second outlet to the fourth inlet, and a fourth pipe connects the fourth outlet to the second inlet.

5. The heat-exchange apparatus as claimed in claim 1, wherein the first heat exchanger and the second heat exchanger compose a structure similar to V shape or U shape.

6. The heat-exchange apparatus as claimed in claim 1, wherein an included angled is formed between an extending direction of the first heat exchanger and an extending direction of the second heat exchanger, and the included angled not greater than 90° and is not 0°.

7. The heat-exchange apparatus as claimed in claim 1, further comprising:

a first chamber, wherein the first heat exchanger and the second heat exchanger are disposed in the first chamber;

a second chamber, wherein the third heat exchanger and the fourth heat exchanger are disposed in the second chamber;

wherein the first chamber is adjacent to the second chamber, and the first chamber is independent from the second chamber, wherein the first heat exchanger is in a first height relative to a first bottom of the first chamber, the third heat exchanger is in a second height relative to a second bottom of the second chamber, the first bottom and the second bottom are the same height or coplanar, the first height is lower than the second height.

* * * * *